US007719492B2

(12) United States Patent
Childs

(10) Patent No.: US 7,719,492 B2
(45) Date of Patent: May 18, 2010

(54) THRESHOLD VOLTAGE COMPENSATION METHOD FOR ELECTROLUMINESCENT DISPLAY DEVICES

(75) Inventor: Mark J. Childs, Wootton Bassett (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 461 days.

(21) Appl. No.: 10/596,868

(22) PCT Filed: Jan. 4, 2005

(86) PCT No.: PCT/IB2005/050029

§ 371 (c)(1),
(2), (4) Date: Jun. 28, 2006

(87) PCT Pub. No.: WO2005/069267

PCT Pub. Date: Jul. 28, 2005

(65) Prior Publication Data

US 2007/0164959 A1 Jul. 19, 2007

(30) Foreign Application Priority Data

Jan. 7, 2004 (GB) ..... 0400216.8

(51) Int. Cl.
*G09G 3/30* (2006.01)

(52) U.S. Cl. ..... 345/76; 345/78; 345/92; 315/169.3

(58) Field of Classification Search ..... 345/76–82, 345/44–46, 92; 315/169.3
See application file for complete search history.

(56) References Cited

U.S. PATENT DOCUMENTS

| | | | | |
|---|---|---|---|---|
| 5,751,279 | A | 5/1998 | Okumura | |
| 6,618,030 | B2 * | 9/2003 | Kane et al. | 345/82 |
| 7,079,094 | B2 * | 7/2006 | Tokioka et al. | 345/82 |
| 7,167,169 | B2 * | 1/2007 | Libsch et al. | 345/211 |
| 2002/0021293 | A1 | 2/2002 | Tam | |
| 2002/0118150 | A1 | 8/2002 | Kwon | |
| 2004/0017161 | A1 | 1/2004 | Choi | |
| 2004/0100430 | A1 * | 5/2004 | Fruehauf | 345/82 |
| 2004/0189559 | A1 * | 9/2004 | Shih | 345/84 |
| 2005/0156829 | A1 * | 7/2005 | Choi et al. | 345/76 |

FOREIGN PATENT DOCUMENTS

| | | | |
|---|---|---|---|
| EP | 0717446 | A2 | 6/1996 |
| WO | 9636959 | A1 | 11/1996 |
| WO | 9848403 | A1 | 10/1998 |
| WO | 0120591 | A1 | 3/2001 |
| WO | 0199191 | A1 | 12/2001 |
| WO | 03038798 | A2 | 5/2003 |
| WO | 03071511 | A2 | 8/2003 |

* cited by examiner

*Primary Examiner*—Amare Mengistu
*Assistant Examiner*—Hong Zhou

(57) ABSTRACT

An active matrix electroluminescent display device has a shorting transistor (30) connected between the gate and drain of the drive transistor (22). Means (42) is provided for measuring a voltage on the data line (6). The shorting transistor (30) can be used to discharge the voltage on the gate of the drive transistor (22) until it switches off. By storing the resultant voltage on the data line (6) through an address transistor (16), the data line is used as one of the control/measurement lines for the threshold measurement.

12 Claims, 3 Drawing Sheets

THRESHOLD VOLTAGE COMPENSATION METHOD FOR ELECTROLUMINESCENT DISPLAY DEVICES

This invention relates to electroluminescent display devices, particularly active matrix display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a. pair of electrodes, one of which is transparent and the other of which is of a material suitable for injecting holes or electrons into the polymer layer.

The polymer material can be fabricated using a CVD process, or simply by a spin coating technique using a solution of a soluble conjugated polymer. Ink-jet printing may also be used. Organic electroluminescent materials exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-driven display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase.

FIG. 1 shows a known pixel circuit for an active matrix addressed electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support. Typically, the thickness of the organic electroluminescent material layer is between 100 nm and 200 nm. Typical examples of suitable organic electroluminescent materials which can be used for the elements 2 are known and described in EP-A-0 717446. Conjugated polymer materials as described in WO96/36959 can also be used.

FIG. 2 shows in simplified schematic form a known pixel and drive circuitry arrangement for providing voltage-programmed operation. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended. The drive transistor 22 draws a current from the power supply line 26.

The drive transistor 22 in this circuit is implemented as a PMOS TFT, so that the storage capacitor 24 holds the gate-source voltage fixed. This results in a fixed source-drain current through the transistor, which therefore provides the desired current source operation of the pixel.

One problem with voltage-programmed pixels, particularly using polysilicon thin film transistors, is that different transistor characteristics across the substrate (particularly the threshold voltage) give rise to different relationships between the gate voltage and the source-drain current, and artefacts in the displayed image result.

Various techniques have been proposed for compensating for these threshold voltage variations. Some techniques perform in-pixel measurement of the drive transistor threshold voltage, and add this threshold voltage to the pixel drive signal, so that the combined drive voltage takes account of the threshold voltage. A pixel circuit to perform this requires two storage capacitors, one for the threshold voltage and one for the pixel drive voltage. Additional switching transistors are also required to enable the threshold voltage to be measured, for example by discharging a capacitance across the gate-source of the drive transistor until it turns off.

Other proposed techniques perform measurement of the threshold voltage externally of the pixel array, and then compensate for the threshold voltage by adjusting the pixel drive signals. These pixel circuits again require additional elements in order to enable signals to be provided to the external circuitry to enable the threshold voltage to be determined. For example, it has been proposed to measure the pixel current at two drive voltages (both within the saturated region of the drive transistor) and to extrapolate the threshold voltage (and mobility) from them. This provides a more complicated pixel drive scheme as well as more complicated pixel circuit.

Although this avoids the need for circuit elements for providing in-pixel compensation, there still remains a need for a simple pixel circuit which enables threshold voltage information to be provided to external measuring circuitry with a simple drive scheme. Any simplification of the pixel circuitry makes manufacturing of large size displays less problematic and improves yield. In addition, a reduction in the number of pixel circuit elements can enable the pixel aperture to be increased (depending on the configuration of the pixel circuits), and a reduction in space needed for the pixel circuitry enables resolution to be increased.

According to the invention, there is provided an active matrix electroluminescent display device comprising an array of display pixels, each pixel comprising:

an electroluminescent (EL) display element;

a drive transistor for driving a current through the display element;

an address transistor for providing a pixel drive signal from a data line to the gate of the drive transistor; and a shorting transistor connected between the gate and drain of the drive transistor, wherein the display device further comprises means for measuring a voltage on the data line.

This pixel arrangement enables one additional transistor (the shorting transistor) to be used to discharge the voltage on the gate of the drive transistor until it switches off. By storing the resultant voltage on the data line (through the address transistor), the data line is used as one of the control/measurement lines for the threshold measurement. This reduces the pixel complexity.

The EL display element and the drive transistor are preferably connected in series between first and second power lines, and the voltage on the second power line can be switchable between two values, one of which causes the EL display element to be turned off. Again, this enables the common cathode line (in particular) to be used as one of the control lines for the threshold measurement operation, again limiting any additional complexity of the pixel circuit.

The data input line is preferably switchable between a voltage driving mode in which it provides voltages to the pixels connected to the line (the normal pixel drive mode) and a floating mode. In the floating mode, the data line can float to the voltage of the gate of the drive transistor of an addressed pixel. Thus, the resultant gate voltage is stored on the data line, in particular on the existing column capacitance.

Thus, each pixel is operable in two modes. In a first, threshold voltage measuring mode, the display element is disabled, the address transistor is turned on and the shorting transistor is turned on. The drive transistor current is shorted to the gate, and the gate voltage thus rises until the transistor switches off (if it is a p-type device). In a second, pixel drive mode, the display element is enabled, the address transistor is turned on and the shorting transistor is turned off. This is the normal drive mode.

During the first, threshold voltage measuring mode, during a first period a predetermined voltage is applied to the data line so that a current is driven through the drive transistor and during a second period the data line is allowed to float so that the voltage on the data line substantially follows the gate voltage of the drive transistor. In this way, the first period makes sure a current is sourced through the drive transistor. The second period allows the drive transistor to be turned off as described above, with the resultant gate voltage stored on the data line.

The drive transistor is preferably a polysilicon TFT, for example a p-type low temperature polysilicon TFT.

A storage capacitor is preferably between the gate and source of the drive transistor.

The invention also provides a method of addressing the pixels of an active matrix electroluminescent display device, comprising an electroluminescent (EL) display element and a drive transistor for driving a current through the display element, the method comprising:

disabling the display element;

applying a first voltage to a data line;

driving a current through the drive transistor, through a shorting transistor connected between the gate and drain of the drive transistor and through an address transistor connected between the gate of the drive transistor and the data line;

allowing the data line electrically to float;

measuring a voltage on the data line; and modifying a data voltage to be applied to the drive transistor using the voltage measured on the data line.

This method provides the operation of the device of the invention.

Disabling the display element preferably comprises applying a disable voltage to a terminal of the display element, for example a common cathode terminal.

The method preferably further comprises-enabling the display element, and addressing the pixel with the modified data voltage on the data line, with the shorting transistor turned off.

The invention will now be described by way of example with reference to the accompanying drawings, in which.

The same reference numerals are used in different figures for the same components, and description of these components will not be repeated.

The invention provides a display pixel circuit in which one additional transistor is connected between the gate and drain of the drive transistor in order to provide a threshold voltage measurement function, externally of the pixel array.

Figure 1:
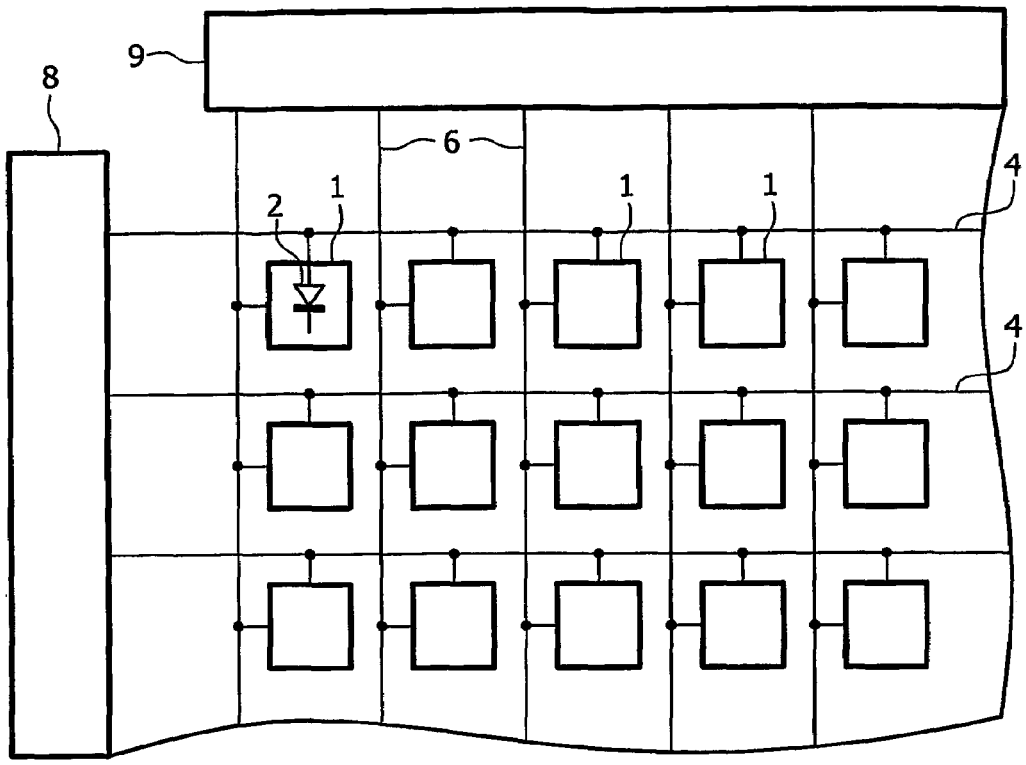
FIG. 1 PRIOR ART
FIG. 1 shows a known EL display device.
Figure 2:
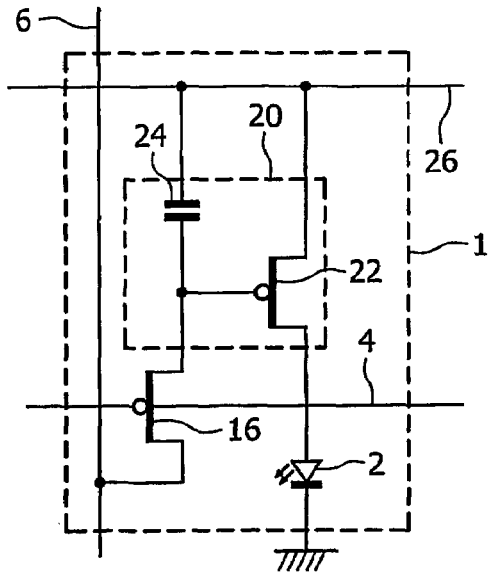
FIG. 2 PRIOR ART
FIG. 2 is a schematic diagram of a known pixel circuit for current-addressing the EL display pixel using an input drive voltage.
Figure 3:
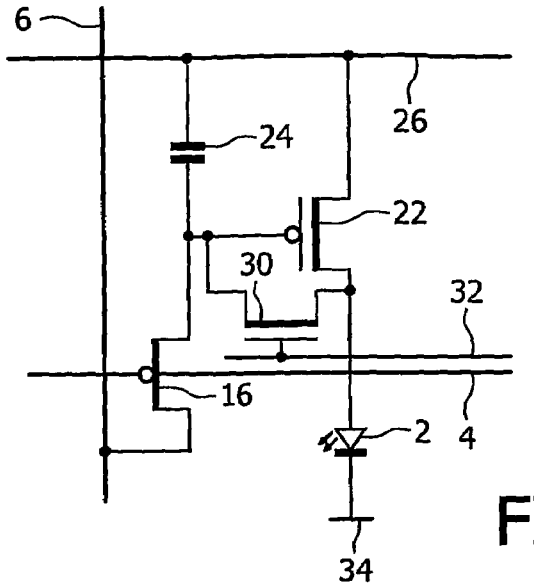
FIG. 3 shows a schematic diagram of pixel layout for a display device of the invention.

FIG. 3 shows a pixel arrangement in accordance with the invention. As in the conventional-pixel of FIG. 2, the pixel is voltage-addressed, and a storage capacitor 24 holds the voltage on the gate of the drive transistor 22 after the pixel addressing phase.

Compared to the standard pixel layout of FIG. 2, the invention provides one additional shorting transistor 30 connected between the gate and drain of the drive transistor 22. This is controlled by an additional control line. 32. The invention also requires the common cathode terminal 34 to be switchable between two voltages, as will be apparent from the description of the operation of the circuit below.

The shorting transistor 30 is used to discharge the voltage on the gate of the drive transistor 22 until it switches off. This discharge operation involves the removal of charge from the storage capacitor 24 until the voltage across the capacitor reaches the threshold voltage. The resulting voltage on the data line, through the address transistor which is turned on, is measured.

Figure 4:
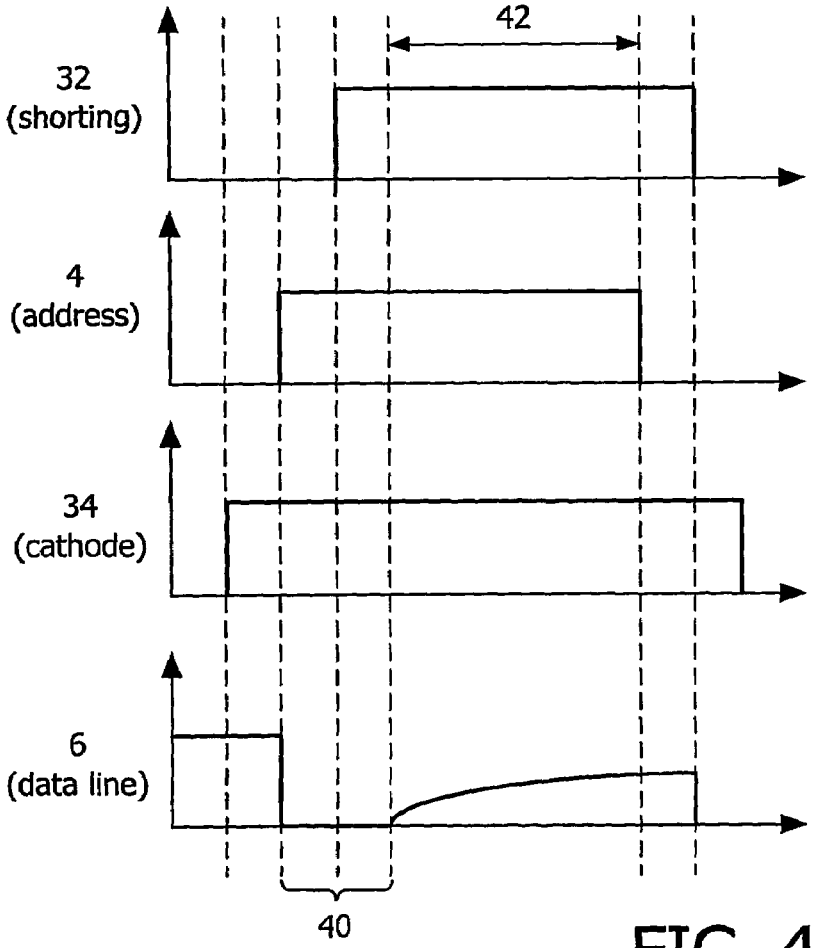
FIG. 4 shows the timing diagrams for the operation of the circuit of FIG. 3.

The operation of the circuit of FIG. 3 will now be explained with reference to the timing diagram of FIG. 4. FIG. 4 shows only the part of the address cycle during which the threshold voltage of the drive transistor is measured.

Plot 4 shows the operation of the address transistor 16. Before (or at the same time as) the address pulse, the cathode line 34 is brought high disabling the display element, by ensuring it is reverse biased.

A first voltage is applied to the data line 6 during period 40, and this voltage ensures that a current can be driven through the drive transistor 22, once the shorting transistor 30 has been turned on. When the shorting transistor is turned on, as shown in plot 32, it provides a path from the power supply line 26, through the drive transistor 22, through the address transistor 16 to the data line 6. As shown, the first voltage on the data line 6 can be ground.

Once a current flow has been established through the drive transistor 22, the data line is made to float, by placing the data line in a high impedance state. The data line is a column conductor for a column of pixels, and is associated with a column capacitance.

As the gate voltage for the drive transistor 22 is held by the capacitor 24, it remains conducting, and the path for the drain-source current is through the shorting transistor 30 and the capacitor 24. This has the effect of reducing is the voltage drop across the capacitor (which was previously the difference between the "first voltage" e.g. ground and the power supply line voltage). When the voltage across the capacitor has "discharged" to the threshold voltage (although the voltage on the gate is rising), the drive transistor 22 switches off, and no further current flows. Thus, the capacitor 24 stores the threshold voltage, and this voltage is transferred to the column capacitance.

In practice, the column capacitance charges relatively slowly, and continues to charge until it reaches the power supply line voltage, as the drive transistor 22 will have significant sub-threshold currents.

The voltage on the data line is measured to enable the threshold voltage to be determined. In view of the sub-threshold currents mentioned above, the data line voltage is measured as soon as the voltage has had time to stabilise at the gate voltage corresponding to switch-off of the drive transistor. This time may be around 1 ms after the data line is allowed to float, and is within the period shown as 42.

Once the threshold voltage has been determined, the pixel data voltages to be applied to the pixels are modified. This can be carried out in the column driver circuits, and can be carried out in the digital or analogue domain. It will be immediately apparent to those skilled in the art how pixel data signals can be modified before application to the display. In some cases, a field store may be required so that all threshold values can be obtained before compensation, or else it may be possible to correct the data voltage to be applied immediately after the measurement.

As will now be apparent, the invention requires only minor modifications to the standard pixel circuit of FIG. 2. In addition to the one extra shorting transistor, a switchable common cathode terminal is required.

The high impedance state for the data input line as well as the voltage measurement circuitry are implemented outside the pixel array, in particular in the column driver circuit. This may be on a separate substrate, and in crystalline silicon, although some or all of the column driver functions can also be implemented on the same substrate as the pixel array, using LTPS processing.

The invention enables compensation for the threshold voltage variations in polysilicon drive transistors (for example a low temperature polysilicon TFTs).

The circuit above uses a p-type drive transistors. There is of course an equivalent n-type implementation.

The processing of the threshold voltage measurement from the pixel circuit of the invention can be carried out in a variety of ways. The measured threshold voltage can be combined digitally with the pixel data signal before D/A conversion) or in the analogue domain. This combination can take place immediately after the threshold voltage measurement, so that the delay in providing image data to the display is kept to a minimum.

Figure 5:
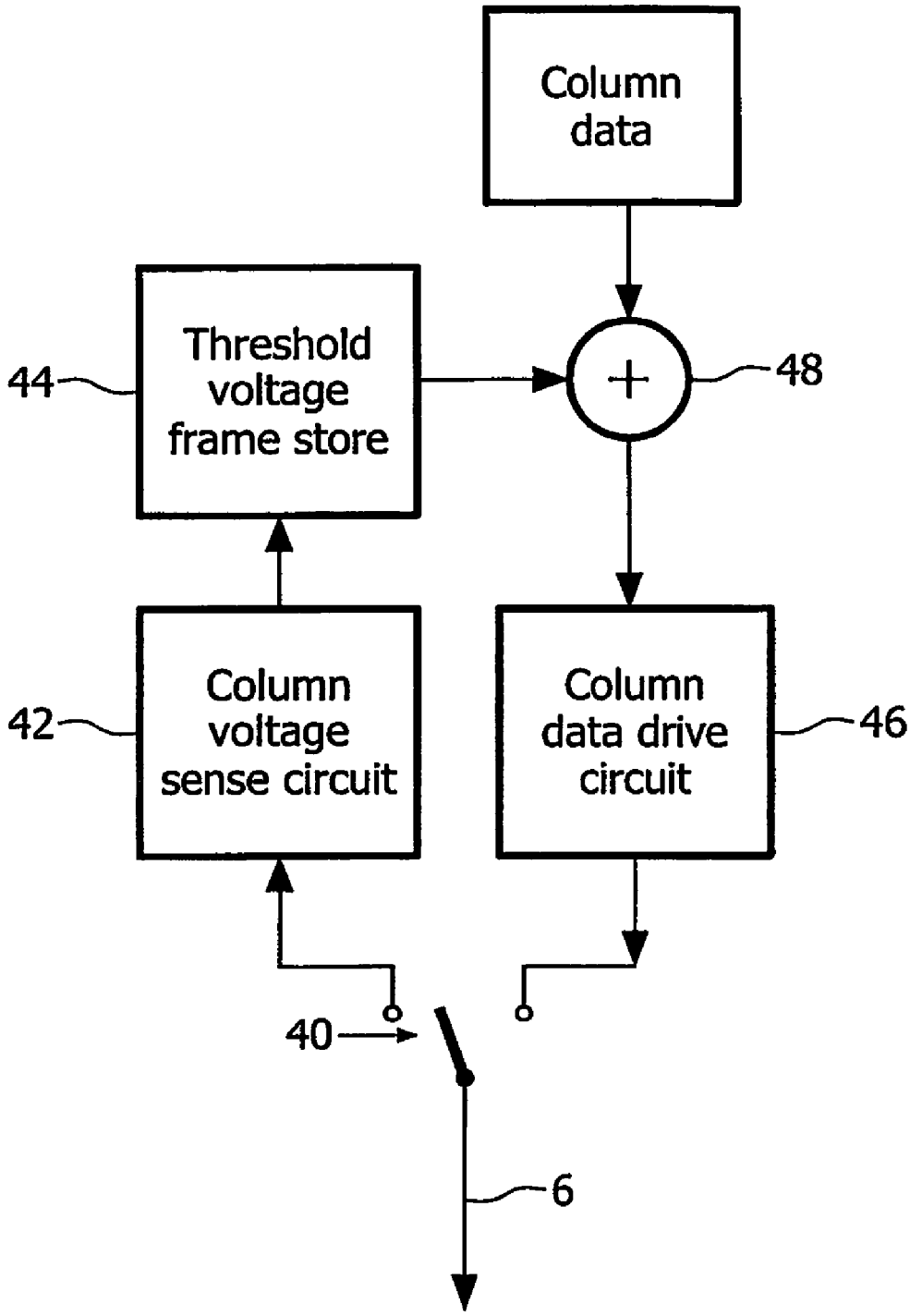
FIG. 5 shows one possible design of column driver circuit for use within the display device of the invention.

FIG. 5 shows one example of possible architecture for the column driver circuit. The circuit is operable in two modes, defined by an output switch 40 for each column.

During a sense mode, the switch 40 connects the column 6 to sense circuitry, comprising a voltage sense circuit 42. The sense circuit 42 measures the voltage on the column at the end of the sense period. It then passes this data to a frame store 44. The frame store stores the threshold voltages of all the drive TFTs in the display.

During a pixel driving mode, the switch 40 connects the column 6 to a column drive circuit 46. The data for a pixel is then supplied to the column driver 46 and the frame store 44 supplies the corresponding threshold voltage. These are added together by adder 48 to give the data plus the threshold voltage offset, which combination signal is passed to the column driver 46. This is an analogue implementation, but the measured threshold voltages could equally be digitised for processing with the pixel data in the digital domain.

The threshold measurement can be carried out once per frame of image data, so that the threshold measurement cycle is part of every addressing phase. In this case, the threshold measurement operations precede the pixel drive operation.

However, the threshold measurement does not need to performed this frequently, as the compensation required derives more from variations across the substrate than differential ageing. Thus, the threshold measurement can be carried out at the beginning of a display cycle, for example each time the display is turned on.

The specific voltages applied to the pixel circuit of the invention have not been described in detail, nor the detailed timing requirements, as these are all routine design parameters to those skilled in the art.

The example of column driver shows as a "means for measuring column voltage" a column voltage sense circuit. This circuit can take various forms, and numerous specific circuits for this purpose will be apparent to those skilled in the art.

Various other modifications will be apparent to those skilled in the art.

The invention claimed is:

1. An active matrix electroluminescent display device comprising an array of display pixels, each pixel comprising:

an electroluminescent (EL) display element (2);

a drive transistor (22) for driving a current through the display element (2);

an address transistor (16) for providing a pixel drive signal from a data line to the gate of the drive transistor (22); and a shorting transistor (30) connected between the gate and drain of the drive transistor, wherein the display device further comprises means (42) for measuring a voltage on the data line (6) after the shorting transistor (30) is turned on and discharges the voltage on the drive transistor (22) until the drive transistor(22) switches off; and a single storage capacitor (24) is directly connected between a power supply line (26) and the gate of the drive transistor (22); and wherein the data input line (6) is switchable between a voltage driving mode in which it provides voltages to the pixels connected to the line and a floating mode in which the data line is placed in a high impedance state thereby allowing the data line to float to the voltage of the gate of the drive transistor of an addressed pixel.

2. A device as claimed in claim 1, wherein the EL display element (2) and the drive transistor (22) are connected in series between first (26) and second (34) power lines.

3. A device as claimed in claim 2, wherein the voltage on the second power line (34) is switchable between two values, one of which causes the EL display element (2) to be turned off.

4. A device as claimed in claim 1, wherein each pixel is operable in two modes:

a first, threshold voltage measuring mode, in which the display element is disabled, the address transistor is turned on and the shorting transistor is turned on; and a second, pixel drive mode, in which the display element is enabled, the address transistor is turned on and the shorting transistor is turned off.

5. A device as claimed in claim 4, wherein during the first, threshold voltage measuring mode, during a first period (40) a predetermined voltage is applied to the data line so that a current is driven through the drive transistor (22) and during a second period (42) the data line is allowed to float so that the voltage on the data line (6) substantially follows the gate voltage of the drive transistor (22).

6. A device as claimed in claim 1, wherein the drive transistor (22) is a poly-silicon TFT.

7. A device as claimed in claim 6, wherein the drive transistor (22) is a low temperature poly-silicon TFT.

8. A device as claimed in claim 1, further comprising a storage capacitor (24) between the gate and source of the drive transistor (22).

9. A method of addressing the pixels of an active matrix electroluminescent display device, comprising an electroluminescent (EL) display element (2) and a drive transistor (22) for driving a current through the display element (2), the method comprising:

disabling the display element (2);

applying a first voltage to a data line (6);

coupling a power supply line (26) directly to the gate of the drive transistor (22) by a single storage capacitor (24);

driving a current through the drive transistor (22), through a shorting transistor (30) connected between the gate and drain of the drive transistor and through an address transistor (16) connected between the gate of the drive transistor and the data line (6);

allowing the data line (6) electrically to float in which the data line is placed in a high impedance state thereby allowing the data line to float to the voltage of the gate of the drive transistor of an addressed pixel;

measuring a voltage on the data line (6); and modifying a data voltage to be applied to the drive transistor (22) using the voltage measured on the data line.

10. A method as claimed in claim 9, wherein disabling the display element comprising applying a disable voltage to a terminal of the display element.

11. A method as claimed in claim 10, wherein disabling the display element comprising applying a disable voltage to terminal (34) of the display element (2) which is common to all display elements.

12. A method as claimed in claim 9, further comprising enabling the display element (2), and addressing the pixel with the modified data voltage on the data line, with the shorting transistor turned off.

* * * * *